US008756970B2

(12) United States Patent
Golovashchenko

(10) Patent No.: US 8,756,970 B2
(45) Date of Patent: Jun. 24, 2014

(54) METHOD OF DRAWING A BLANK BY PREFORMING A CHANNEL IN A PREFORM THAT IS SUBSEQUENTLY DRAWN INTO A DIE CAVITY

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 511 days.

(21) Appl. No.: 13/046,993

(22) Filed: Mar. 14, 2011

(65) Prior Publication Data

US 2012/0234070 A1 Sep. 20, 2012

(51) Int. Cl.
*B21D 22/21* (2006.01)

(52) U.S. Cl.
USPC ..... 72/351

(58) Field of Classification Search
USPC ..... 72/348, 349, 350, 351, 353.2, 402, 72/379.4, 54, 56, 57, 60, 466.7, 72/453.01–453.19; 29/421.1
See application file for complete search history.

(56) References Cited

U.S. PATENT DOCUMENTS

| | | | | |
|---|---|---|---|---|
| 3,596,485 | A | 8/1971 | Burk | |
| 4,409,808 | A * | 10/1983 | Festag et al. | 72/60 |
| 5,016,458 | A * | 5/1991 | De Smet | 72/57 |
| 6,276,185 | B1 * | 8/2001 | Owens | 72/350 |
| 6,493,913 | B2 | 12/2002 | Streubel et al. | |
| 7,293,442 | B1 | 11/2007 | Ghiran et al. | |
| 7,765,848 | B2 * | 8/2010 | Nagai et al. | 72/348 |

OTHER PUBLICATIONS

Matwick, Seward E, B.S. Mathematics US Air Force Academy, 2001, An Economic Evaluation of Sheet Hydroforming and Low Volume Stamping and the Effects of Manufacturing Systems Analysis, Submitted to the Department of Materials Science and Engineering in Partial Fulfillment of the Requirements for the Degree of Master of Science in Materials Science and Engineering at the Massachusetts Institute of Technology, Feb. 2003.

Rexroth Bosch Group, Fluid Forming Hydroforming with Rexroth, Maximum Precision with Single-Component Forming, Printed in Germany, Apr. 2010, www.boschrexroth.com, info.bri@boschrexroth.de.

Dr. Taylan Altan, FMA,Sheet hydroforming in automotive applications—Press Technology Tech Cell—The Fabricator.com, Article, Apr. 15, 2002.

Bryen, T. CSA, Illumina, Welcome to ProQuest-CSA, your Guide to Discovery—Improved Techniques Reduce Deep Drawing Operations, Sheet Met. Ind. vol. 62, No. 9, pp. 480-490, Sep. 1985.

* cited by examiner

*Primary Examiner* — Shelley Self
*Assistant Examiner* — Matthew G Katcoff
(74) *Attorney, Agent, or Firm* — Damian Porcari; Brooks Kushman P.C.

(57) ABSTRACT

A method of forming a blank into a part shape is provided in which the blank is drawn into one or more channels sequentially to form at least one pocket of material that is available to be drawn into the die cavity. Each pocket is formed by applying liquid pressure or mechanical pressure to form the blank into the channels. The channels may be filled with a liquid to reduce friction. Alternatively, portions of the blank may be drawn into a channel to form a first stage preform that includes a pocket. The pocket of the first stage preform is then drawn into the die cavity in a first partial drawing stage. The steps of drawing material into the channel and then into the die cavity may be repeated one or more times until the part is fully drawn into the desired shape.

9 Claims, 5 Drawing Sheets

METHOD OF DRAWING A BLANK BY PREFORMING A CHANNEL IN A PREFORM THAT IS SUBSEQUENTLY DRAWN INTO A DIE CAVITY

TECHNICAL FIELD

This disclosure relates to a method of drawing a blank into a part shape in which a channel is formed in a blank holding area of a die set to reduce stress at the entrance of a die cavity.

BACKGROUND

Traditional sheet metal forming processes generally begin with a drawing operation in which a blank is drawn or stamped to a desired shape. Drawing processes are limited by the depth of draw required to form a panel and the width of the flange that is drawn into the die cavity. As the depth of the cavity increases, the flange of the blank must be wider to provide additional material that may be drawn into the cavity. The stress applied to the blank at the entrance of the cavity should be less than the yield stress of the sheet metal blank. If the yield stress exceeds the yield stress of the sheet metal blank, deformation at the entrance of the die cavity may result in the formation of splits in the material.

The drawing process may be divided into several steps to reduce stress at the entrance of the die cavity. Factors contributing to the stress at the entrance of the die cavity include the width of the flange, the amount of clamping force applied by the blank holder to prevent wrinkling, the coefficient of friction, and the size of the radius at the entrance to the die cavity. If the stress at the entrance of the die exceeds its maximum value after which the strain is localized, and the blank is splitting, it may be necessary to use several draw dies for a deep drawing operation. If the number of dies is increased, substantial expense is incurred to fabricate dies. In addition, if several draw dies are required, additional draw presses must be provided in a press line, or extra positions must be provided in a transfer press.

Other approaches to reducing the stress at the entrance of the die cavity may include the use of hydro-mechanical drawing techniques in which a punch is driven into a blank that is positioned over a die cavity that is filled with a liquid. As the punch engages the blank, a pocket of metal may accumulate around the punch as a result of the resistance of the fluid to be force applied by the punch. Hydro-mechanical drawing operations are not normally effective to form detailed features in a panel. In addition, hydro-mechanical drawing of automotive panels requires hundreds of liters of process water to be pumped into and out of the die cavity as the blank is formed by the punch. Process cycle times are lengthened due to the need to pump the process water in and out of the die cavity.

Another approach to reducing the stress at the entrance of the cavity may include providing a lubricant that reduces the friction between the blank, the die, and the clamping ring at the entrance of the cavity.

Aluminum alloys and advanced high strength steel (AHSS) are more subject to splitting due to stresses applied during a drawing operation. Aluminum and AHSS have reduced formability compared to low carbon steel. Problems relating to providing a multi-step drawing process are increased with aluminum and AHSS alloys. The use of hydro-mechanical drawing processes may increase the formability of draw panels, but is slow due to the need to pump process water into and out of the die cavity.

The above problems are addressed by this disclosure as summarized below.

SUMMARY

According to one aspect of the disclosure, a method of forming a blank into a part shape is provided in which material is drawn into one or more channels sequentially by applying liquid pressure or pressure from a hard tool to form the blank into each of the channels. Pressure is applied to the outboard channels first, and then more inboard channels are formed, as the edge of the panel approaches the die cavity. The number and depth of the channels may be increased depending upon the depth of the draw operation. For some parts, a single channel may be sufficient, while other parts with a greater draw depth may require two or more channels to be assured that sufficient material is available for part formation. The draw channels effectively reduce the width of the flange and also reduce the stress at the entrance into the die cavity.

According to another aspect of the disclosure, a method is disclosed for forming a sheet metal part from a blank that is clamped between a blank holder and a die. Pressure is applied at a selected area against the first side of the blank. The blank is formed into a pocket that is disposed on the second side of the blank that is on the opposite side of the blank from the selected area. The pressure is relieved on the selected area and the blank is then drawn into the die cavity and pulled out of the pocket.

According to other aspects of the disclosure, pressure may be applied at the selected area by providing a liquid under pressure through a channel formed in a blank holder. Alternatively, the step of applying pressure at the selected area may further comprise engaging the blank with a channel punch that is advanced through the blank holder.

In the event that multiple channels are provided to assure an adequate depth of draw without excessive stress, first and second selected areas and first and second pockets may be provided. Pressure is relieved on the first selected area at the same time that pressure is applied at a second selected area that is inboard from the first selected area against the first side of the blank. The blank is formed into a second pocket that is inboard from the first pocket and is disposed on the second side of the blank that is on the opposite side of the blank from the selected area. Pressure is relieved on the second selected area before the drawing step.

The die may define a die cavity, and the first and second pockets may be formed in a blank holder that is outboard from the die cavity. The first and second pockets extend, at least in part, around the periphery of the die cavity.

According to another aspect of the disclosure, a method of drawing a blank to form a drawn panel is provided. A first peripheral pocket is formed in the blank and a portion of the blank that is clamped by a blank holder and lower die. A second peripheral pocket is formed in the blank and a portion of the blank that is inboard of the first pocket and is clamped by the blank holder on the lower die. The blank is then drawn into the lower die to form the drawn panel.

According to the latter method, the steps of forming the first and second peripheral pockets are performed by porting the liquid under pressure to a top side of the blank to cause the blank to be formed into a first and a second pocket forming area on the lower die. The first and second pockets may be formed sequentially with the first pocket being formed initially and the second pocket being formed later after relieving the pressure in the first pocket. The step of drawing the blank into the die cavity of the lower die is performed after pressure is relieved in the second pocket.

Alternatively, the steps of forming the first and second peripheral pockets may be performed by drawing the blank into the first pocket with the first channel punch that engages a top side of the blank to cause the blank to be formed into the first pocket forming area on the lower die. The blank is then drawn into the second pocket forming area on the lower die. The first and second pockets are formed sequentially by the channel punch with the first pocket being formed first and the second pocket being formed after the first channel is retracted from engagement with the blank. The blank is drawn into the lower die after the second channel punch is retracted from engagement with the blank.

The lower die may include first and second cavities that are filled with a liquid when the steps of forming the first and second peripheral pockets are performed.

In another alternative embodiment of the disclosure, portions of the blank disposed in the blank holding portion of the die set may be drawn into a channel that is then drawn into the die cavity. The steps of drawing material into the channel and then into the die cavity may be repeated one or more times until the part is fully drawn into the desired shape.

These and other features of this disclosure will be better understood in view of the attached drawings and the following detailed description of the illustrated embodiments.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
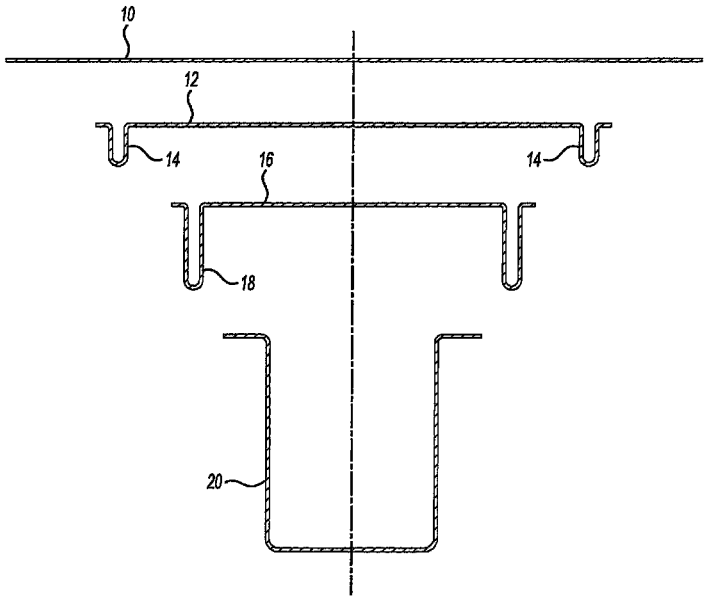
FIG. 1 is a diagrammatic view showing a sequence for forming a drawn part in one tool during a single stroke of the press.

Referring to FIG. 1, a blank 10 is shown as it is initially introduced into the manufacturing process disclosed as one embodiment of the disclosure. A first stage preform 12 has a first pocket 14 that is formed about the periphery. The first stage preform 12 is shown in cross-section in FIG. 1. The first pocket 14 may be a channel extending about all or part of a draw die cavity that is illustrated in FIGS. 2-10. A second stage preform 16 has a second pocket 18 that is formed about the periphery and is inboard of the first pocket 14. A final drawn part 20 is formed by a punch that is illustrated in FIGS. 5 and 8.

Figure 2:
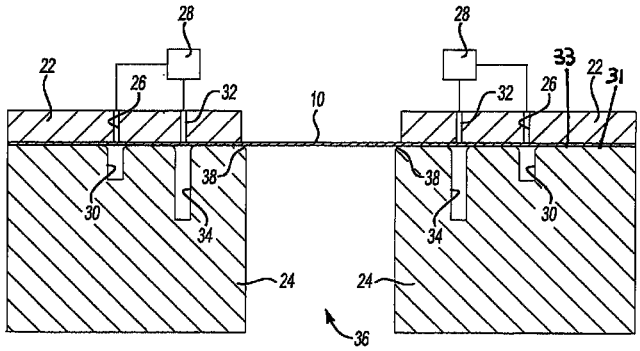
FIG. 2 is a diagrammatic cross-sectional view of a blank retained on a die by a blank holder.

Referring to FIGS. 2 through 5, one embodiment of the disclosure is illustrated in which a blank 10 is formed into a final drawn part 20 in a series of hydro-drawing steps. Referring to FIG. 2, the blank 10 is shown being held by a blank holder 22 on a lower die 24. A first channel 26 is defined within the blank holder 22 and is in fluid flow communication with a fluid source 28. The lower die 24 includes a flange 31 that defines a top surface 33. The lower die 24 also defines a draw cavity 36 that has a die entry radius 38. The flange 31 surrounds the cavity 36. A first recess or outer recess 30 is provided in the lower die 24. A second channel 32 is also defined by the blank holder 22 and a second recess or inner recess 34 is defined by the lower die 24. The inner recess 34 extends deeper into the lower die 24 than the outer recess 32. A punch 40 shown in FIG. 5 is moved by a press (not shown) into the die cavity 36 to form the final drawn part 20.

Figure 3:
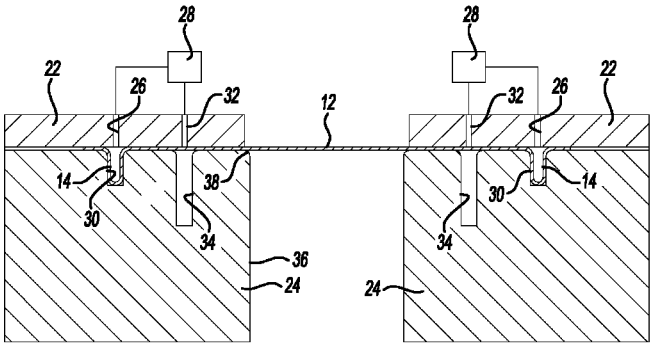
FIG. 3 is a diagrammatic cross-sectional view of the blank with a peripheral portion hydro-drawn into a first pocket.

Referring to FIG. 3, a first stage preform 12 is shown with the first pocket 14 is formed in a hydro-drawing step in which a fluid under pressure is provided from the fluid source 28 through the first channel 26 to form the first pocket 14 in the first recess 30 defined by the lower die 24.

Figure 4:
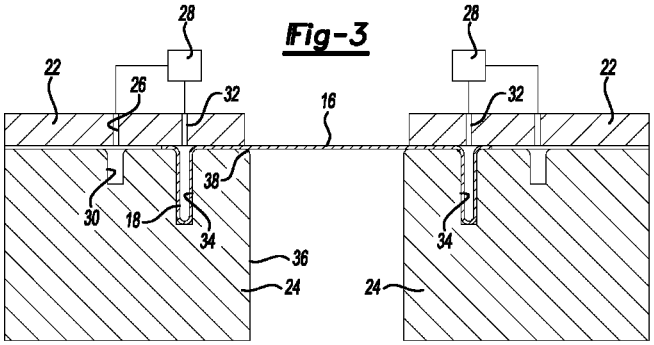
FIG. 4 is a diagrammatic cross-sectional view of the blank with a peripheral portion hydro-drawn into a second pocket that is inboard of the first pocket.
Figure 5:
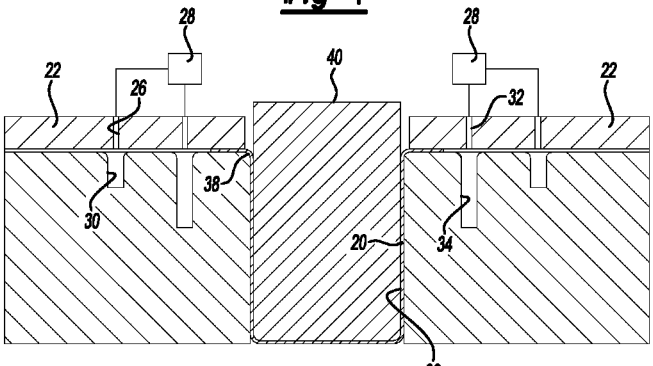
FIG. 5 is a diagrammatic cross-sectional view of the blank drawn into a part shape.

Referring to FIG. 4, the second stage preform 16 shown with the second pocket 18 that is formed in a hydro-drawing step. In the hydro-drawing step, fluid under pressure is provided from the fluid source 28 through the second channel 32 to form the second pocket 18 into the second recess 34 that is defined in the lower die 24.

Referring to FIG. 5, the final drawn part 20 is shown with the punch 40 disposed in the draw cavity 36. The final part 20 is drawn across the die entrance radius 38 that is provided to reduce the strain in the metal while forming the final part shape 20.

Figure 6:
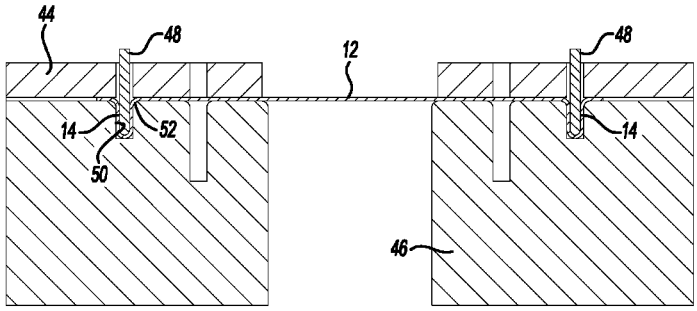
FIG. 6 is a diagrammatic cross-sectional view of an alternative embodiment in which the blank has a peripheral portion that is drawn into a first pocket by a first punch.
Figure 7:
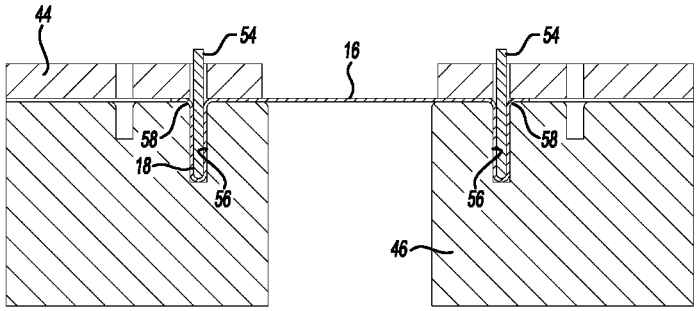
FIG. 7 is a diagrammatic cross-sectional view of the embodiment of FIG. 6 showing the blank with a peripheral portion drawn into a second pocket by a second punch.
Figure 8:
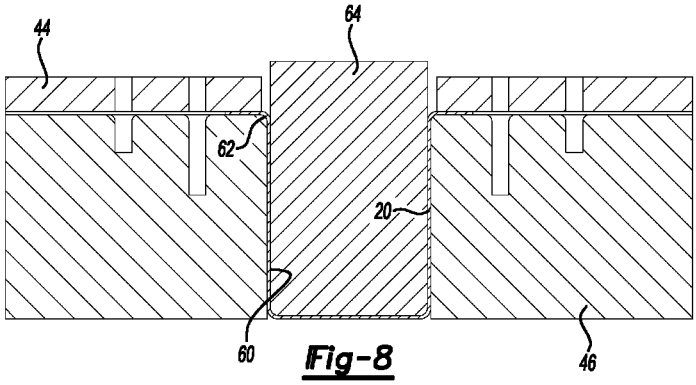
FIG. 8 is a diagrammatic cross-sectional view of the embodiment of FIG. 6 showing the blank formed into a drawn part shape.

Referring to FIGS. 6 through 8, an alternative embodiment is shown in which the first pocket 14 (shown in FIG. 6) and second pocket 18 (shown in FIG. 7) are formed by punches that are operated by the press (not shown) or a hydraulic ram (not shown).

Referring to FIG. 6, the first stage preform 12 is illustrated with a first channel punch 48 forming a first pocket 14 in the preform 12 by drawing a peripheral portion into a first recess 50 formed in the lower die 46. The first pocket 14 is drawn over first recess entry radius 52.

Referring to FIG. 7, the first stage preform 12 (shown in FIG. 6) is engaged by a second channel punch 54 to form the second pocket 18 in the second stage preform 16. Metal is drawn from the first pocket 14 (shown in FIG. 6) into the second recess 56 formed in the lower die 46. The first stage preform 12 is drawn across a second pocket entry radius 58, as it is drawn into the second recess 56. The second pocket entry radius 58 is provided to reduce the strain on the panel as is drawn into the second recess 56.

Referring to FIG. 8, the final drawn part 20 is shown in a draw cavity 60 defined by the lower die 46. The entrance to the draw cavity 60 includes a die entrance radius 62 that is provided to reduce the stress on the panel, as it is drawn into the draw cavity 60. The press (not shown) drives the punch 64 into the draw cavity 60 and forms the second stage preform 16 into the shape of the final drawn part 20.

Figure 9:
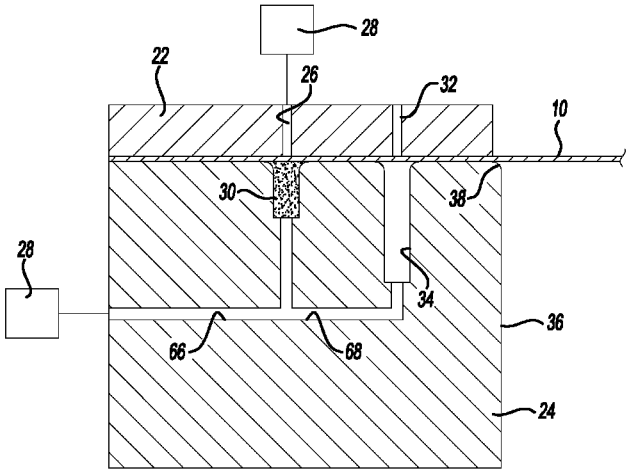
FIG. 9 is a fragmentary diagrammatic cross-sectional view of another hydro-drawn embodiment in which fluid is supplied to a cavity below the blank in the first pocket prior to hydro-drawing.

Referring to FIG. 9, an alternative embodiment is illustrated that differs from the embodiment of FIGS. 2-4 in that liquid is provided both above and below the blank. For brevity, corresponding parts are referred to with the same numerals in FIGS. 2-4 and 9. Only part of the die set is shown that comprises the left half of the die set. The blank 10 is held by a blank holder 22 on a lower die 24. A first channel 26 is defined within the blank holder 22 and is in fluid flow communication with a fluid source 28. A second channel 32 is also defined by the blank holder 22. A first recess 30 and a second recess 34 are defined by the lower die 24. The first and second recesses 30, 34 are filled with the liquid through first and second channels 66 and 68, respectively, which are formed in the lower die 24 and are in fluid flow communication with the fluid source 28. The fluid in the first and second recesses 30, 34 is under lower pressure than the pressure in the first and second channels 26, 32 of the in the blank holder 22. The fluid in the recesses 30, 34 below the blank 10 reduces friction at the entrance to the recesses 30, 34.

Figure 10:
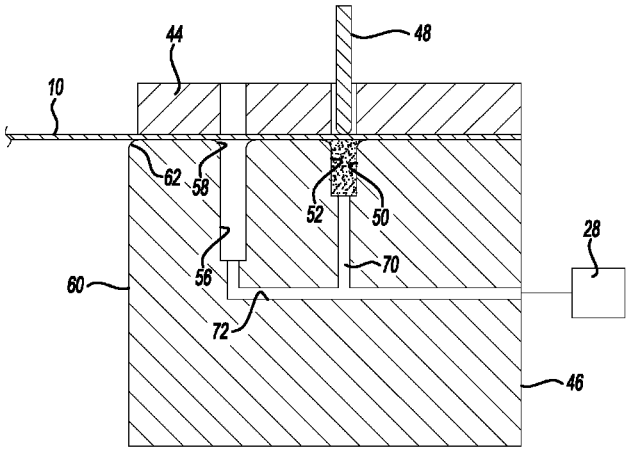
FIG. 10 is a fragmentary diagrammatic cross-sectional view of another embodiment utilizing a punch and wherein fluid is supplied to a cavity below the blank in the first pocket prior to drawing a peripheral portion into a pocket with a punch.

Referring to FIG. 10, another alternative embodiment is illustrated that differs from the embodiment of FIGS. 5-8 in that liquid is provided both above and below the blank 10. For brevity, corresponding parts are referred to with the same numerals in FIGS. 5-8 and 10. Only part of the die set is shown which comprises the right half of the die set. The blank 10 is shown as it is held by a blank holder 44 on a lower die 46. A first channel punch 48 is disposed within the blank holder 44 that is driven by the press (not shown) or a hydraulic drive (not shown). A first recess 50 and a second recess 56 are defined by the lower die 46. The first and second recesses 50, 56 are filled with the liquid through first and second channels 70 and 72, respectively, which are formed in the lower die 46 and are in fluid flow communication with the fluid source 28. The fluid in the first and second recesses 50, 56 below the blank 10 reduces friction at the entrance to the recesses 50, 56.

Figure 11:
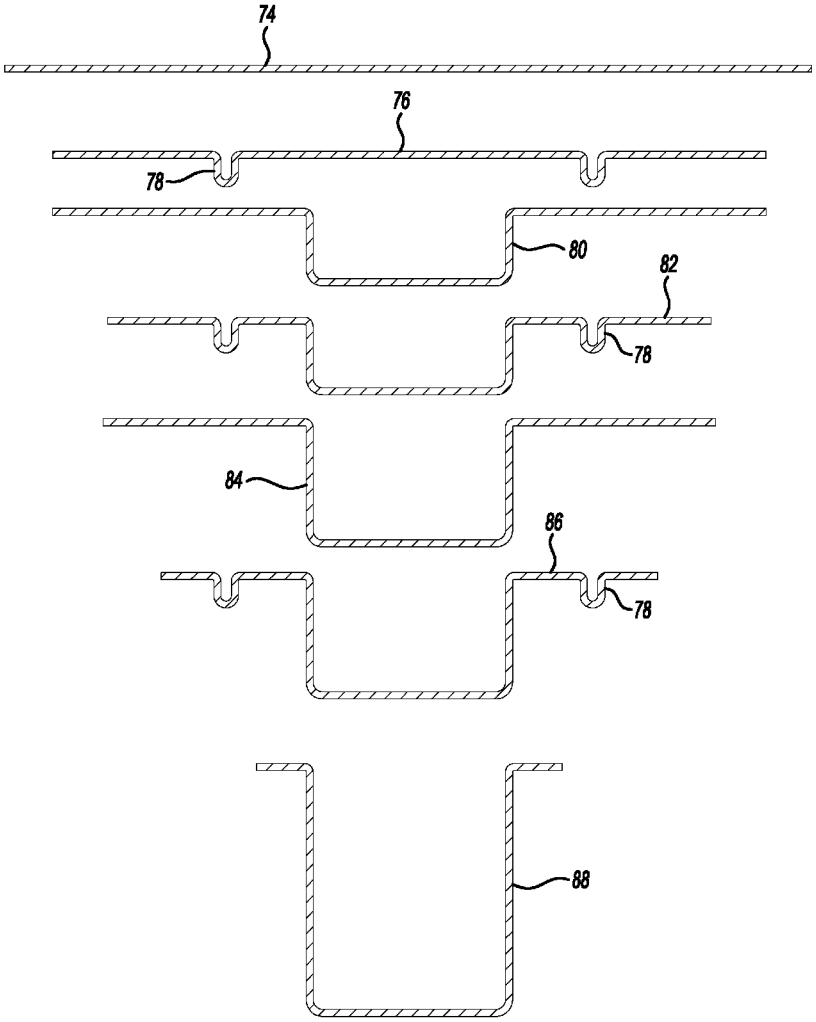
FIG. 11 is a diagrammatic view showing an alternative sequence for forming a drawn part in which material is drawn into a channel several times and is drawn from the channel into the die cavity.

Referring to FIG. 11, an alternative embodiment of the process is illustrated in which portions of the blank 74 disposed in a blank holding portion of the die set, such as the blank holders 22, 44 (shown in FIGS. 2-5), may be drawn into a channel, such as channels 26, 48 (shown in FIGS. 2-5) to form a first stage preform 76 that includes a pocket 78. The pocket 78 of the first stage preform 76 is then drawn into the die cavity, such as draw cavity 36, 60 (shown in FIGS. 2-5 and 8), to form a first partial drawing stage. The steps of drawing material into the channel and then into the die cavity may be repeated one or more times until the part is fully drawn into the desired shape. A second stage preform 82 is then created by reforming the pocket 78 that is then drawn into a second drawing stage 84. A third stage preform 86 may then be created by reforming the pocket 78 that is then drawn into a final drawn part 88. This process may be repeated again depending upon the required depth of the draw.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of forming a part comprising:

clamping a blank between a blank holder and a lower die that defines a top surface and a cavity;

applying pressure at a first selected area against a first side of the blank, that is disposed on the top surface;

forming a first pocket into the blank at the first selected area;

relieving the pressure at the first selected area;

applying pressure at a second selected area against a first side of the blank that is disposed on the top surface, wherein the second selected area is disposed between the first pocket and the cavity in the die;

forming a second pocket into the blank disposed on the second side of the blank opposite the second selected area;

relieving the pressure on the second selected area; and drawing the blank into the cavity and out of the second pocket.

2. The method of claim 1 wherein the step of applying pressure at the first selected area further comprises providing a liquid under pressure through a channel formed in the blank holder.

3. The method of claim 1 wherein the step of applying pressure at the first selected area further comprises engaging the blank with a channel punch that is advanced through the blank holder.

4. The method of claim 1 wherein the step of applying pressure at the second selected area further comprises providing a liquid under pressure through a channel formed in a blank holder.

5. The method of claim 1 wherein the step of applying pressure at the second selected area further comprises engaging the blank with a channel punch that is advanced through the blank holder.

6. The method of claim 1 wherein the top surface opens into a first recess defined by the lower die and the first pocket is formed in the first recess.

7. The method of claim 6 wherein the top surface opens into a second recess defined by the lower die and the second pocket is formed in the first recess, wherein the second recess is disposed between the first recess and the cavity.

8. The method of claim 7 wherein the first recess is filled with a liquid before the step of forming the blank into the first pocket and the second recess is filled with a liquid before the step of forming the blank into the second pocket.

9. The method of claim 7 wherein the second recess is deeper than the first recess.

* * * * *